US011245172B1

(12) United States Patent
Dressel

(10) Patent No.: US 11,245,172 B1
(45) Date of Patent: Feb. 8, 2022

(54) WIDEBAND WAVEGUIDE COMBINER/MODE-CONVERTER TRANSFORMING N RECTANGULAR WAVEGUIDES IN THE $TE_{10}$ RECTANGULAR MODE TO A SINGLE CIRCULAR WAVEGUIDE OUTPUT IN THE $TE_{01}$ MODE

(71) Applicant: Raytheon Company, Waltham, MA (US)

(72) Inventor: Earl M. Dressel, Albuquerque, NM (US)

(73) Assignee: RAYTHEON COMPANY, Waltham, MA (US)

( * ) Notice: Subject to any disclaimer, the term of this patent is extended or adjusted under 35 U.S.C. 154(b) by 58 days.

(21) Appl. No.: 16/844,549

(22) Filed: Apr. 9, 2020

Related U.S. Application Data

(60) Provisional application No. 62/946,465, filed on Dec. 11, 2019.

(51) Int. Cl.
*H01P 5/12* (2006.01)
*H01P 5/02* (2006.01)

(52) U.S. Cl.
CPC ..... *H01P 5/12* (2013.01); *H01P 5/024* (2013.01)

(58) Field of Classification Search
CPC ..... H01P 5/12; H01P 5/024
USPC ..... 333/100
See application file for complete search history.

(56) References Cited

U.S. PATENT DOCUMENTS 3,010,088 A * 11/1961 Kahn ..... H01P 1/163 333/251
2007/0115077 A1* 5/2007 Chan ..... H01P 1/161 333/127

* cited by examiner

*Primary Examiner* — Robert J Pascal
*Assistant Examiner* — Kimberly E Glenn
(74) *Attorney, Agent, or Firm* — Daly, Crowley, Mofford & Durkee, LLP

(57) ABSTRACT

A power combiner for combining a plurality of radio frequency signals into a combined output signal includes: a circular waveguide having a cross-section and three or more waveguides, each waveguide morphing to align with a common axis at a cross-section of the circular waveguide wherein each one of the three or more rectangular input waveguides gradually transitions from a rectangular cross-section to a cross-section resembling a pie slice of a composite circular cross section.

18 Claims, 3 Drawing Sheets

WIDEBAND WAVEGUIDE COMBINER/MODE-CONVERTER TRANSFORMING N RECTANGULAR WAVEGUIDES IN THE $TE_{10}$ RECTANGULAR MODE TO A SINGLE CIRCULAR WAVEGUIDE OUTPUT IN THE $TE_{01}$ MODE

CROSS-REFERENCE TO RELATED APPLICATIONS

This application claims priority from U.S. Provisional application Ser. No. 62/946,465 filed on Dec. 11, 2019, which is incorporated herein by reference.

STATEMENT REGARDING FEDERALLY SPONSORED RESEARCH

Not Applicable.

FIELD

This disclosure relates generally to microwave devices, and, more particularly, to a high power microwave combiner device.

BACKGROUND

It is desirable for a high power radio-frequency (RF) transmitter operating in a microwave frequency to provide a high power microwave (HPM) signal. In an HPM system based on a high-power RF source, electromagnetic radiation is extracted from the RF source using waveguide.

Efficient extraction of RF power from microwave tube sources is a key element of HPM technology. An azimuthally balanced way to harvest maximal RF energy from a high-power pulsed magnetron RF source is by radial extraction via rectangular waveguide from every other resonator. However, this extraction approach presents the subsequent problem of combining RF power in separate waveguides into a single feed suitable for a directive antenna. Also, pulsed operation of the high-power magnetron introduces a time interval over which plasma oscillations are somewhat incoherent before settling into the stable $\pi$ mode. During this time interval the frequency varies from the eventual resonant frequency, and it is critical that reflected waves at these spurious frequencies not disrupt formation of the $\pi$ mode, or else the magnetron will not reliably form a HPM pulse. A second objective of the HPM pulsed magnetron is to be tunable over a finite frequency band. Consequently, robust RF design of the HPM system requires that downstream waveguide elements maintain a low reflection coefficient over an adequately broad frequency band.

SUMMARY

The present disclosure teaches an N-port wideband waveguide combiner comprising a waveguide with circular cross-section; and three or more rectangular waveguides, each waveguide morphing to align with a common axis at the cross-section of the circular waveguide.

The N-port wideband waveguide combiner may include one or more of the following features, individually or in combination to include: wherein the three or more rectangular waveguides comprises six waveguides; wherein each one of the three or more rectangular input waveguides gradually transitions from a rectangular cross-section to a cross-section resembling a pie slice of a composite circular cross section; wherein each one of the three or more rectangular input waveguides also bends by 45° to align with the common axis of the circular cross section; wherein converging walls of the three or more rectangular input waveguides merge to form thin septa that abruptly terminate when the composite cross section becomes circular; wherein the circular waveguide comprises an extension section to optimize the circular waveguide output; wherein all surfaces have a continuous first derivative in the direction of wave propagation to minimize reflection; wherein each one of the three or more rectangular input waveguides preserves wave impedance of the rectangular input waveguide throughout the transition to eliminate impedance mismatches that would cause reflection; wherein each one of the waveguide surfaces includes varying spatial transition rates to allow axial length to be optimized to minimize axial length while maintaining propagation performance; or wherein the extension section to optimize the circular waveguide output has a length, for example, selected from one of the lengths of 0.1 wavelength, 0.2 wavelength, 0.3 wavelength, 0.4 wavelength, 0.5 wavelength, 0.75 wavelength and 1.0 wavelength.

The present disclosure also teaches a power combiner for combining a plurality of radio frequency signals into a combined output signal comprising a circular waveguide having a cross-section; and three or more waveguides, each waveguide morphing to align with a common axis at a cross-section of the circular waveguide wherein each one of the three or more rectangular input waveguides gradually transitions from a rectangular cross-section to a cross-section resembling a pie slice of a composite circular cross section.

The power combiner may include one or more of the following features, individually or in combination to include: wherein each one of the three or more rectangular input waveguides also bends by 45° to align with the common axis of the circular cross section; wherein converging walls of the three or more rectangular input waveguides merge to form thin septa that abruptly terminate when the composite cross section becomes circular; wherein all surfaces have a continuous first derivative in the direction of wave propagation to minimize reflection; wherein each one of the three or more rectangular input waveguides preserves wave impedance of the rectangular input waveguide throughout the transition to eliminate impedance mismatches that would cause reflection; wherein the circular waveguide comprises an extension section to optimize the circular waveguide output.

The present disclosure also teaches a power combiner for combining $TE_{10}$ rectangular mode microwave signals into a combined output $TE_{01}$ circular mode microwave signal comprising: a circular waveguide having a cross-section to provide the output $TE_{01}$ mode microwave signal; and three or more rectangular input waveguides, each rectangular input waveguide adapted to propagate a $TE_{10}$ rectangular mode microwave signal, each rectangular input waveguide morphing to align with a common axis at the cross-section of the circular waveguide.

The power combiner may include one or more of the following features, individually or in combination to include: wherein each one of the three or more rectangular input waveguides gradually transitions from a rectangular cross-section to a cross-section resembling a pie slice of a composite circular cross section; wherein converging walls of the three or more rectangular input waveguides merge to form thin septa that abruptly terminate when the composite cross section becomes circular.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the broad concepts, systems and techniques described herein. Like numbers in the figures denote like elements.

DETAILED DESCRIPTION

The features and other details of the disclosure will now be more particularly described. It will be understood that any specific embodiments described herein are shown by way of illustration and not as limitations of the concepts, systems and techniques described herein. The principal features of this disclosure can be employed in various embodiments without departing from the scope of the concepts sought to be protected.

Figure 1:
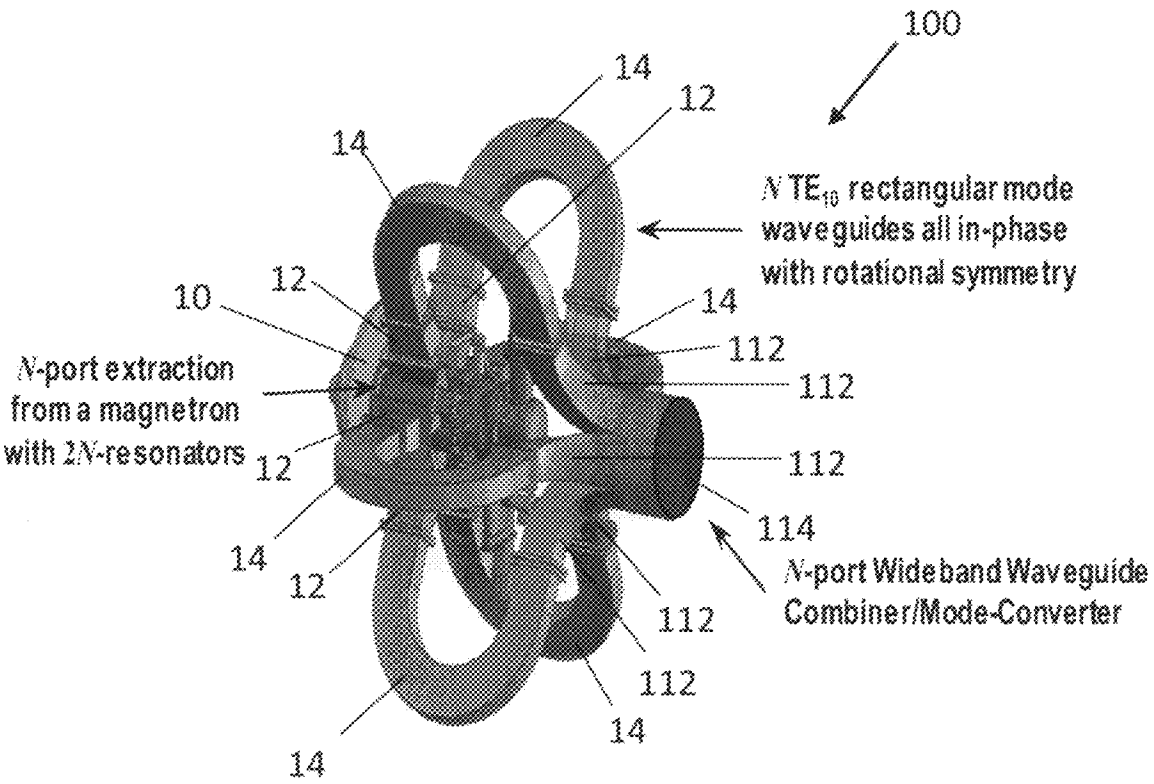
FIG. 1 is Wideband Waveguide Combiner/Mode-Converter Transforming N Rectangular Waveguides in the $TE_{10}$ Rectangular Mode to a Single Circular Waveguide Output in the $TE_{01}$ Mode according to the disclosure.

Referring now to FIG. 1, an N-port Wideband Waveguide Combiner/Mode-Converter 100 Transforming N Rectangular Waveguides in the $TE_{10}$ Rectangular Mode to a Single Circular Waveguide Output in the $TE_{01}$ Mode, here N being 6, is shown. This disclosure relates to methods and apparatus for combining multiple (N>2) rectangular waveguides, each propagating the lowest-order $TE_{10}$ rectangular mode with common frequency, phase, and power, into a circular waveguide propagating the axisymmetric $TE_{01}$ circular mode with high mode purity and low reflection. Reciprocity requires that the inverse also applies, hence the Wideband Waveguide Combiner/Mode-Converter 100 (herein also referred to as combiner 100) will distribute an incident high-purity $TE_{01}$ circular mode into multiple rectangular waveguides with low reflection, each propagating the $TE_{10}$ rectangular mode with common frequency, phase, and with equipartition of power. The combiner 100 is wideband, operating over a 5-10% bandwidth without substantial degradation in performance, and can handle extremely high power, making it suitable for High-Power Microwave (HPM) applications.

A known high power magnetron power source for radio frequency (RF) energy is described in U.S. Pat. No. 9,805,901 B2 issued on Oct. 31, 2017, having the same assignee as the present invention and incorporated herein by reference. As described therein, a magnetron assembly to provide a high power magnetron power source 10 includes a compact magnetic field generator for high-power magnetrons, a high-power magnetron (internal within the magnetron assembly), and multiple output waveguides. One or more wedge shaped output waveguides are coupled to a compact magnetic field generator. Each output waveguide fits between two annular wedge magnets, and each waveguide is mechanically coupled to an RF extraction waveguide or to a termination plate. In the present disclosure, the magnetron assembly includes six extraction waveguides 12.

The Wideband Waveguide Combiner/Mode-Converter 100 includes a plurality of input waveguides 112, here having six input waveguides 112. The Wideband Waveguide combiner comprising a circular waveguide 114 having a cross-section; and three or more waveguides and here being six input waveguides 112, each waveguide morphing to align with a common axis at a cross-section of the circular waveguide 114.

R.F. energy exiting extraction waveguides 12 follows the path defined by the waveguides 14, respectively. Each waveguide 14 branch away from a respective extraction waveguide 12 in an arch shape and connect to a respective input waveguide 112 of the combiner 100. The waveguide 14 with an arch shape is well known in the art and is shaped to accommodate the geometry required to connect to the respective input waveguide 112 as shown. Depending upon the proximity of the input waveguide 112 to the extraction waveguide 12 alternative shapes could be used for connecting the extraction waveguide 12 to the input waveguide 112.

The purpose of this embodiment is to combine an N-fold multiplicity of radially-extracting rectangular waveguides of a pulsed magnetron, all with identical phase and power, into a single waveguide with a well-defined mode of propagation, with very low reflection over a reasonably large frequency band. The particular magnetron for which this disclosure was developed had six extraction ports, but the design principle applies to any number of azimuthally symmetric extractions ports greater than two. The output waveguide mode, the $TE_{01}$ circular mode, is both a natural synthesis of the combination and is particularly useful as the ideal feed for downstream antenna components disclosed hereinbelow.

RF power is extracted from the magnetron into N separate radial waveguides distributed azimuthally about the magnetron axis, with identical phase and power in all ports, as shown in FIG. 1. In the N-port extraction approach, a 180° H-bend of standard radius reverses the outward-radial direction of propagation in minimal axial length, where a standard 45' H-bend mates the N waveguides to the Wideband Waveguide Combiner/Mode-Converter 100. FIG. 1 shows a six-port extraction from a HPM pulsed magnetron feeding a six-port embodiment of the N-port Wideband Waveguide Combiner/Mode-Converter. RF energy entering the six separate rectangular waveguides 112 follows the path defined by the waveguides and is combined and the combined R.F. energy exits the circular waveguide 114.

Figure 2:
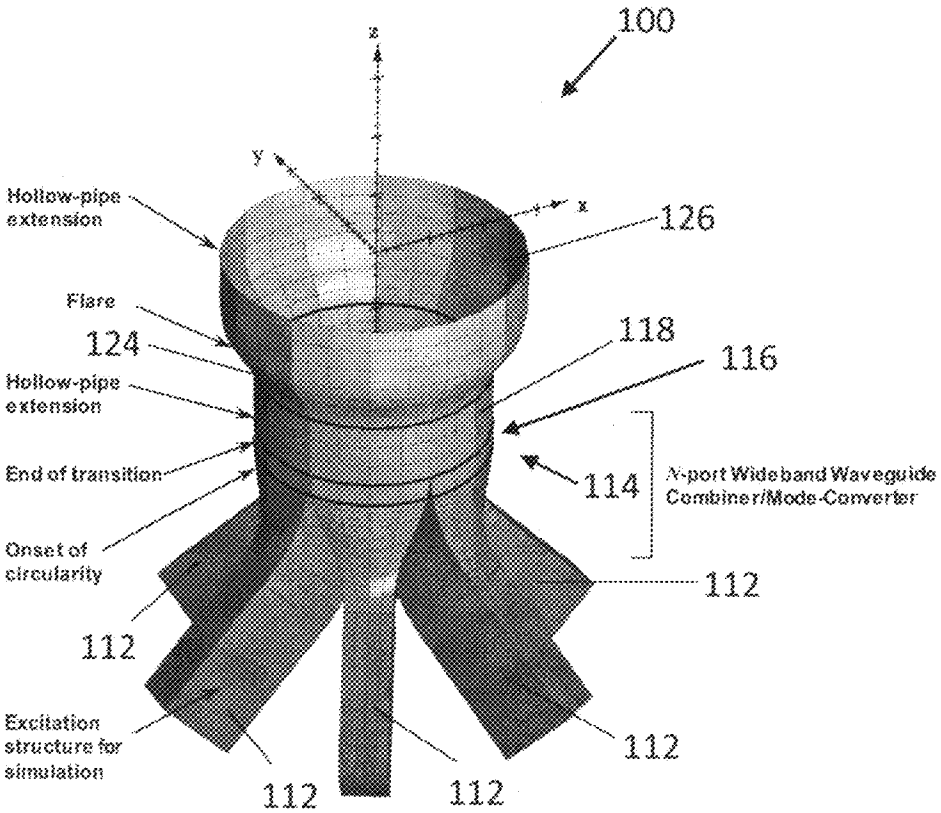
FIG. 2 shows an expanded view of a six-port embodiment of the N-port Wideband Waveguide Combiner/Mode-Converter.
Figure 2A:
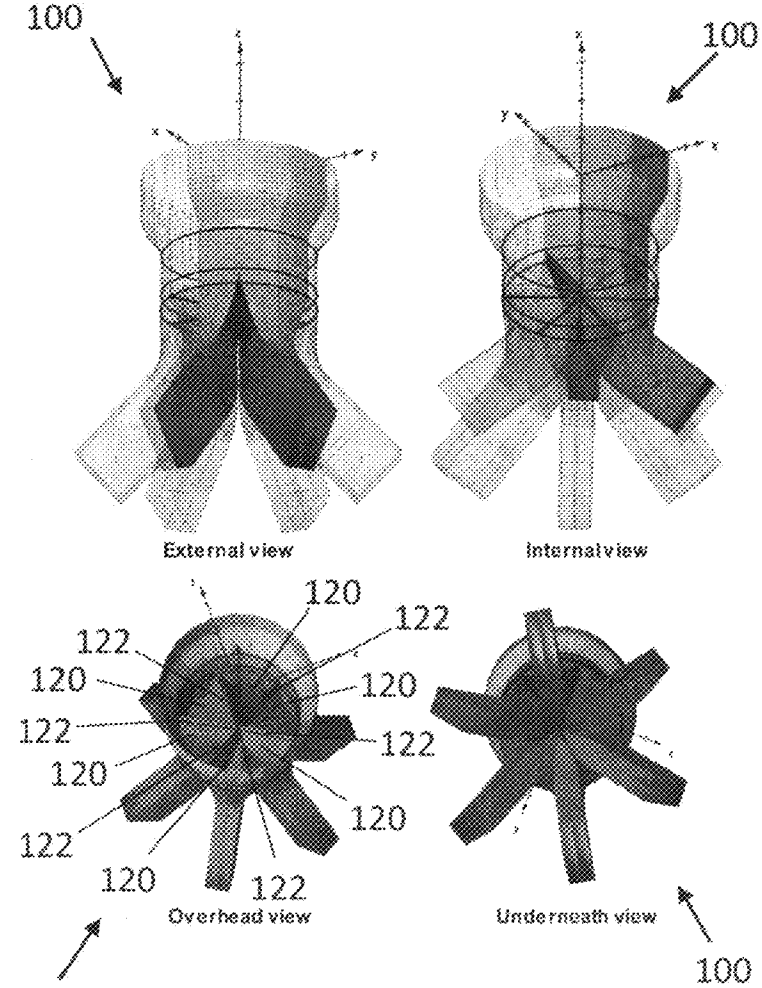
FIG. 2A shows various views of a six-port embodiment of the N-port Wideband Waveguide Combiner/Mode-Converter.

Referring now to FIGS. 2 and 2A, the N-port Wideband Waveguide Combiner/Mode-Converter 100 transforms the $TE_{10}$ rectangular mode of the separate rectangular waveguides 112 into the $TE_{01}$ circular mode propagating in a single waveguide 114. In this design, each separate rectangular waveguide 112 gradually transitions from a rectangular cross-section to a cross-section resembling a pie slice 120 of a composite circular cross section. During this transition, each separate morphing waveguide also bends by 45° to align with the common axis of the circular cross section. The converging walls of the separate waveguides merge to form thin septa 122 that abruptly terminate when the composite cross section becomes circular. FIG. 2 visualizes the geometry of a six-port embodiment of the N-port Wideband Waveguide Combiner/Mode-Converter. FIG. 2A shows various views of a six-port embodiment of the N-port Wideband Waveguide Combiner/Mode-Converter with additional structures as noted. The top left view is an external view of combiner 100. The top right view is an internal view of combiner 100. The bottom left view is an overhead view of combiner 100. The bottom right view is an underneath view of combiner 100.

As shown in FIG. 2 in more detail, the combiner 100 includes a plurality of input waveguides 112, here having six input waveguides 112 and an output circular waveguide 114. Each separate rectangular waveguide 112 gradually transitions from a rectangular cross-section to a cross-section resembling a pie slice to provide a combined circular cross section at the upper limit of region 116. At the end of the transition, the region 116 appends an extension section 118 so that the transition to $TE_{01}$ circular mode from the ends of the waveguides 112 stabilizes in the circular waveguide output. In the shown embodiment, the structure further includes a flare section 124 and a hollow pipe extension 126 to provide a larger aperture.

Figure 3:
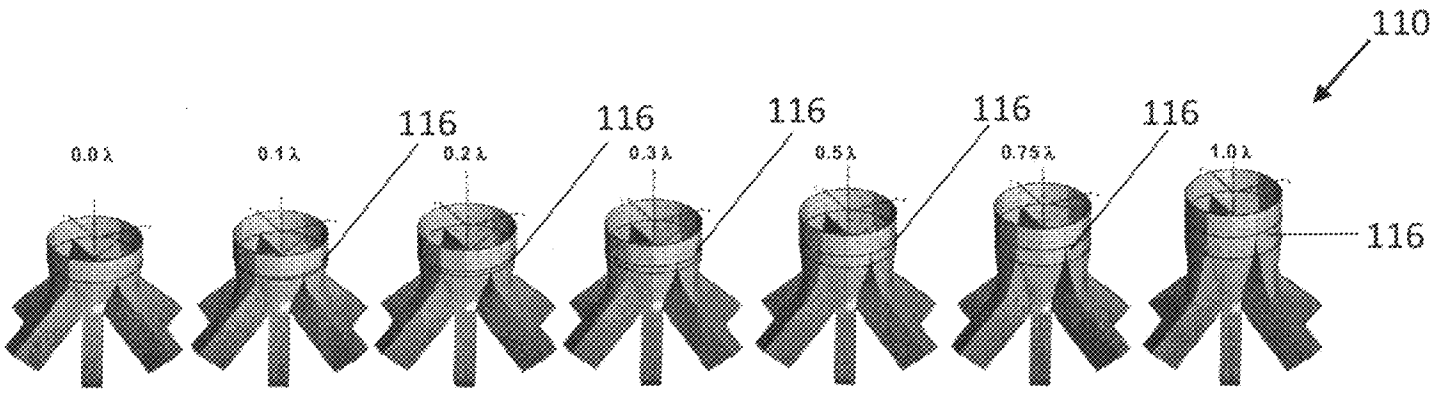
FIG. 3 shows various embodiments of a six-port embodiment of the N-port Wideband Waveguide Combiner/Mode-Converter.

Design guidelines for the transitioning geometry are 1) all surfaces must have a continuous first derivative (no discontinuities) in the direction of wave propagation to minimize reflection, 2) the waveguide preserves the wave impedance of the rectangular waveguide throughout the transition to eliminate impedance mismatches that would cause reflection, and 3) the geometry-generating computer code generating the waveguide surfaces includes the capability to vary spatial transition rates to allow axial length to be optimized to minimize axial length while maintaining propagation performance. A suite of computer codes generate and visualize the waveguide combiner geometry, write input files for simulating the EM performance of the design by a commercial EM simulation code, mine simulation data files of pertinent EM data to compute figures of merit (FoMs) evaluating design performance, and visualize the results. FIG. 3 displays a progression of candidate designs which, through simulation and FoM evaluation, enable the design to be optimized for the most compact configuration that sufficiently maintains the requisite EM performance that is achievable by a very long, slowly-tapered configuration. FIG. 3 shows visualization of the controlled length extension (or contraction) of the embodiment to optimize wideband performance against axial length. As can be observed, the right most embodiment of the combiner 110 has an extension section of the region 116 of a length of one wavelength. The second to the right most embodiment of the combiner 110 has an extension section of the region 116 of a length of three quarters wavelength. The third to the right most embodiment of the combiner 110 has an extension section of the region 116 of a length of one-half wavelength. The middle embodiment of the combiner 110 has an extension section of the region 116 of a length of three tenths wavelength. The third to the left most embodiment of the combiner 110 has an extension section of the region 116 of a length of two tenths wavelength. The second to the left most embodiment of the combiner 110 has an extension section of the region 116 of a length of one tenth wavelength. The left most embodiment of the combiner 110 has no extension section which is equivalent of having an extension length of zero wavelength. By varying and selecting the appropriate extension length for extension section 118, the axial length of the transition to $TE_{01}$ circular mode from rectangular waveguides 112 can be minimized while maintaining requisite electromagnetic performance.

All references cited herein are hereby incorporated herein by reference in their entirety.

Having described preferred embodiments, it will now become apparent to one of ordinary skill in the art that other embodiments incorporating their concepts may be used. For example, elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

It is felt therefore that these embodiments should not be limited to disclosed embodiments, but rather should be limited only by the spirit and scope of the appended claims.

What is claimed is:

1. An N-port wideband waveguide combiner comprising:
a circular waveguide having a cross-section;
three or more rectangular input waveguides; and
one transition waveguide for each rectangular waveguide, beginning with the rectangular waveguide cross-section and morphing in both direction and shape to align with a common axis at the cross-section and completely fill the cross-section of the circular waveguide wherein each one of the three or more rectangular input waveguides gradually transitions from a rectangular cross-section to a cross-section resembling a pie slice of a composite circular cross section.

2. The N-port wideband waveguide combiner as recited in claim 1 wherein each one of the three or more rectangular input waveguides also bends by 45° to align with the common axis of the circular cross section.

3. The N-port wideband waveguide combiner as recited in claim 1 wherein converging walls of the three or more rectangular input waveguides merge to form thin septa that abruptly terminate when the composite cross section becomes circular.

4. The N-port wideband waveguide combiner as recited in claim 1 wherein the N transition waveguides comprise an extension section to optimize the circular waveguide output.

5. The N-port wideband waveguide combiner as recited in claim 4 wherein the extension section to optimize the circular waveguide output can be increased in axial length from its minimum by any amount.

6. The N-port wideband waveguide combiner as recited in claim 1 wherein all surfaces have a continuous first derivative in the direction of wave propagation to minimize reflection.

7. The N-port wideband waveguide combiner as recited in claim 1 wherein each one of the three or more rectangular input waveguides preserves wave impedance of the rectangular input waveguide throughout the transition to eliminate impedance mismatches that would cause reflection.

8. The N-port wideband waveguide combiner as recited in claim 1 wherein each one of the waveguide surfaces includes varying spatial transition rates to allow axial length to be optimized to minimize axial length while maintaining propagation performance.

9. A power combiner for combining a plurality of radio frequency signals into a combined output signal comprising:
a circular waveguide having a cross-section; and
three or more waveguides, each waveguide morphing to align with a common axis at a cross-section of the circular waveguide wherein each one of the three or more rectangular input waveguides gradually transitions from a rectangular cross-section to a cross-section resembling a pie slice of a composite circular cross section.

10. The power combiner as recited in claim 9 wherein each one of the three or more rectangular input waveguides also bends by 45° to align with the common axis of the circular cross section.

11. The power combiner as recited in claim 9 wherein converging walls of the three or more rectangular input waveguides merge to form thin septa that abruptly terminate when the composite cross section becomes circular.

12. The power combiner as recited in claim 11 wherein all surfaces have a continuous first derivative in the direction of wave propagation to minimize reflection.

13. The power combiner as recited in claim 12 wherein each one of the three or more rectangular input waveguides preserves wave impedance of the rectangular input waveguide throughout the transition to eliminate impedance mismatches that would cause reflection.

14. The power combiner as recited in claim 9 wherein the circular waveguide comprises an extension section to optimize the circular waveguide output.

15. The power combiner as recited in claim 14 wherein the extension section to optimize the circular waveguide output has a length selected from one of the lengths of 0.1 wavelength, 0.2 wavelength, 0.3 wavelength, 0.4 wavelength, 0.5 wavelength, 0.75 wavelength and 1.0 wavelength.

16. A power combiner for combining a plurality of $TE_{10}$ rectangular mode microwave signals into a combined output $TE_{01}$ mode microwave signal comprising:

a circular waveguide having a cross-section to provide the output $TE_{01}$ mode microwave signal; and three or more rectangular input waveguides, each rectangular input waveguide adapted to propagate a $TE_{10}$ rectangular mode microwave signal, each rectangular input waveguide morphing to align with a common axis at the cross-section of the circular waveguide.

17. The power combiner as recited in claim 16 wherein each one of the three or more rectangular input waveguides gradually transitions from a rectangular cross-section to a cross-section resembling a pie slice of a composite circular cross section.

18. The power combiner as recited in claim 17 wherein converging walls of the three or more rectangular input waveguides merge to form thin septa that abruptly terminate when the composite cross section becomes circular.

* * * * *